US009228285B2

(12) United States Patent
Hasanreisoglu

(10) Patent No.: US 9,228,285 B2
(45) Date of Patent: Jan. 5, 2016

(54) WASHER/DRYER

(75) Inventor: Levent Hasanreisoglu, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 1707 days.

(21) Appl. No.: 12/596,408

(22) PCT Filed: Apr. 2, 2008

(86) PCT No.: PCT/EP2008/053947

§ 371 (c)(1),
(2), (4) Date: Mar. 29, 2010

(87) PCT Pub. No.: WO2008/125498

PCT Pub. Date: Oct. 23, 2008

(65) Prior Publication Data

US 2010/0223962 A1 Sep. 9, 2010

(30) Foreign Application Priority Data

Apr. 17, 2007 (TR) ..... a 2007 02593

(51) Int. Cl.
*D06F 35/00* (2006.01)
*D06F 37/22* (2006.01)

(52) U.S. Cl.
CPC ..... *D06F 37/225* (2013.01)

(58) Field of Classification Search
CPC ..... D06F 37/225
USPC ..... 68/3 R, 23.2, 200
See application file for complete search history.

(56) References Cited

U.S. PATENT DOCUMENTS

| | | | | |
|---|---|---|---|---|
| 2,723,737 | A * | 11/1955 | Hammell et al. | 192/12 A |
| 2,901,294 | A * | 8/1959 | Smith | 384/141 |
| 3,060,713 | A * | 10/1962 | Burkall | 68/23.2 |
| 3,490,569 | A * | 1/1970 | Reed | 192/18 R |
| 2005/0210929 | A1 * | 9/2005 | George et al. | 68/12.06 |
| 2008/0141466 | A1 * | 6/2008 | Leidig et al. | 8/159 |
| 2008/0141732 | A1 * | 6/2008 | Leidig et al. | 68/13 R |

FOREIGN PATENT DOCUMENTS

| | | |
|---|---|---|
| GB | 605731 | 7/1948 |
| GB | 1320605 | 6/1973 |
| JP | 2002 136792 A | 5/2002 |
| WO | 01/29304 A | 4/2001 |

OTHER PUBLICATIONS

Machine translation of Derwent Abstract of JP 2002136792 to Chikatoshi et al., May 2002.*

* cited by examiner

*Primary Examiner* — Michael Barr
*Assistant Examiner* — Benjamin L Osterhout
(74) *Attorney, Agent, or Firm* — Venjuris P.C.

(57) ABSTRACT

The present invention relates to a washer/dryer (1) that comprises one or more chambers (12) disposed on the drum (2) wherein a sufficient amount of water for counterbalancing the unbalanced load is delivered and stored when there is an unbalanced load.

10 Claims, 6 Drawing Sheets

WASHER/DRYER

Figure 1:
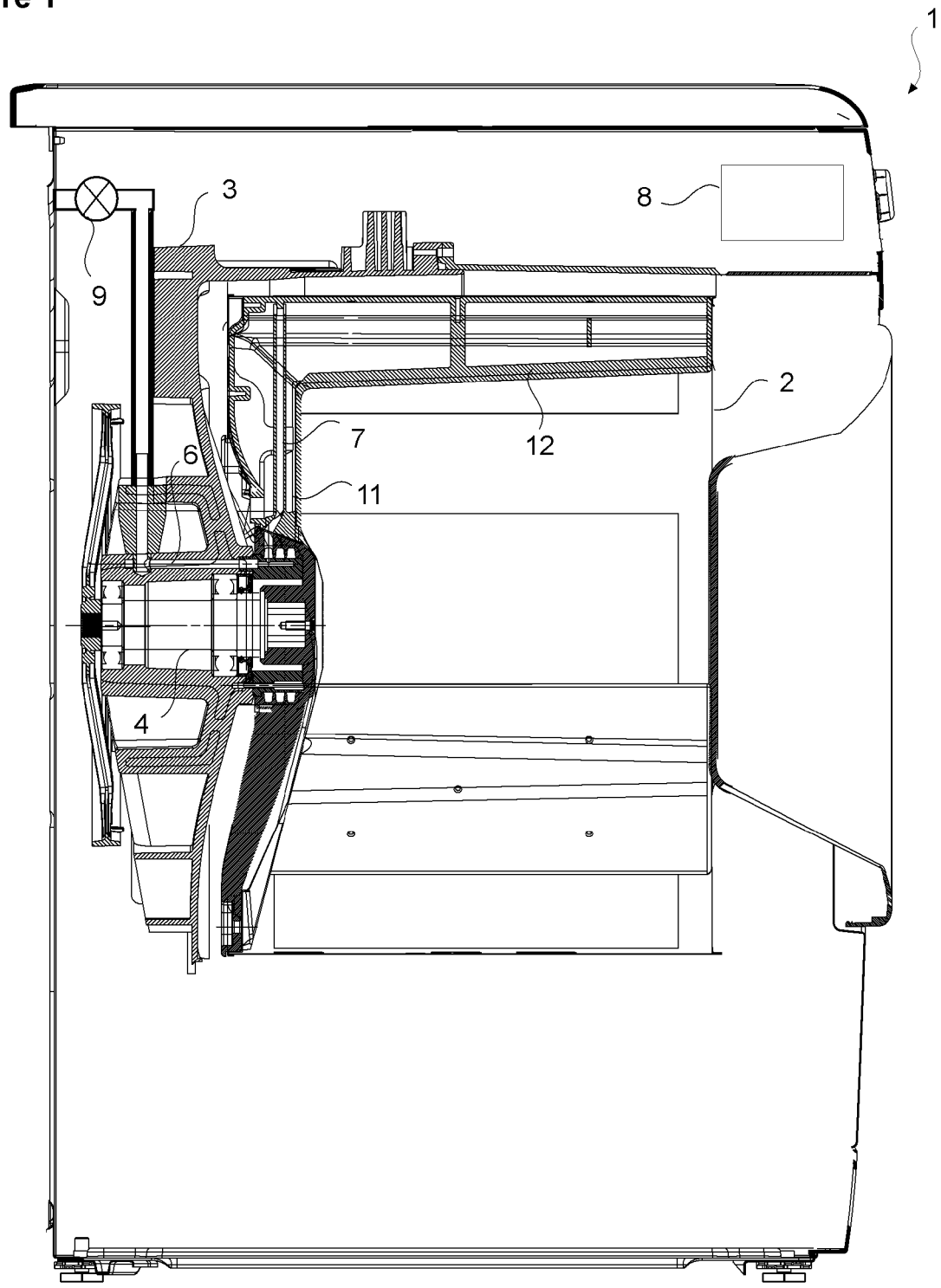

The present invention relates to a washer/dryer wherein the unbalanced load within the drum is balanced by using a fluid.

In washer/dryers, particularly in washing machines, the laundry is emplaced in a drum preferably rotating around a horizontal axis. In different steps of the washing program the laundry is cleaned with the help of water and detergent by rotating the drum at different speeds. While the drum is being rotated, the laundry is not distributed homogeneously within the drum and the laundry piles up in some regions causing an uneven load distribution. Particularly in the spinning step wherein the drum is being rotated at high speeds, the unbalanced load distribution generates vibration. Those vibrations not only generate noise and result in consumer dissatisfaction but also cause the machine to wear out. Moreover, the spinning performance at high speeds is adversely affected In the current state of the art, a great number of solutions are developed for balancing the unbalanced load. Of these, a widely used solution is adding weights to the machine for increasing its inertia. However, since fixed weights make the transportation of the machine difficult, in some of the state of the art embodiments, adding a fluid, mostly water, to the machine is suggested. Water is filled in the chambers secured on the tub or the drum. In a group of embodiments, the fluid is added to the machine once after transportation and the same fluid is used constantly. In another group of embodiments, the fluid required for balancing is received into the machine during operation and discharged out at the end of the operation.

In state of the art Great Britain Patent Application No GB1320605, an automatic balancing mechanism is explained wherein water is delivered to the peripheral chambers of the drum through the shaft when unbalanced load occurs. In this embodiment, the drum rear wall distends in case of unbalanced load and a valve opens, closes to supply water received from the shaft to the chamber.

In state of the art Great Britain Patent Application No GB605731, a dynamically self balancing unit is explained that delivers water to the fluid receptacles on the drum by means of channels formed on the shaft bearing. In this embodiment, the shaft distends with respect to unbalanced load and opens the ports of the channels. Water enters into the respective receptacle upon opening of the channel port maintaining dynamical balancing.

In state of the art Japanese Patent Application No JP2002136792, an additional grooved element is described leaning on the shaft bearing that directs water to be delivered to water storage tanks on the drum when there is unbalanced load. This additional element does not rotate and the water in the groove is delivered to the water storage tanks while the shaft bearing rotates by means of a channel.

The aim of the present invention is the realization of a washer/dryer wherein the unbalanced load is effectively balanced.

The washer/dryer realized in order to attain the aim of the present invention, explicated in the first claim and the respective claims thereof, comprises one or more troughs situated between the drum rear wall and the shaft bearing, rotating together with the drum, and maintaining the water received from the main supply and passing through the feeder line to be continuously delivered to the distribution line and the chambers by the centrifugal force effect generated due to rotation of the drum, and at least partially encompassing the portion of the bearing extending into the rear wall.

A housing is provided on the drum rear wall wherein the shaft bearing is fitted. The troughs are situated on the inner periphery of this housing, partially encompassing the shaft bearing. Water received from the line in the shaft bearing is distributed to the chambers on the drum for eliminating the imbalances that may occur during washing/spinning.

Thus, the amount of water that needs to be transferred to the respective chamber depending on the amount and position of unbalanced load can be maintained by means of this configuration whereby the required amount of water can be delivered to the required chamber without calculating the times of opening, closing of the valves or the position of the chambers.

In another embodiment of the present invention, the trough encompasses the portion of the bearing extending into the rear wall all around.

In another embodiment of the present invention, the trough partially encompasses the portion of the bearing extending into the rear wall to face the outlet of the feeder line on an arc segment.

In another embodiment of the present invention, more than one trough is arranged discontinuously on a line. During the rotation of the drum, at least one trough corresponds to be opposite the feeder line outlet at certain intervals. In this embodiment, since the timing of water delivery into the feeder line is important, time controlled valves are used. Thus the length of the shaft bearing can be reduced.

In another embodiment of the present invention, sealing elements are used between the bearing and the drum for preventing passage of water from one trough to another. Thus the right amount of water can be delivered to the respective chamber without leakage or seepage.

In yet another embodiment of the present invention, channels, situated between the bearing and the drum wall, serve as sealing elements which are configured between the troughs, forming a water screen when filled with water and preventing the passage of water between the troughs. Thus passage of water between the troughs is prevented without needing to use a sealing element.

By means of the present invention, unbalanced load is counterbalanced by mechanically delivering water to the required region for decreasing the effect to a minimum when the control unit detects a condition of unbalanced load.

The washer/dryer realized in order to attain the aim of the present invention is illustrated in the attached figures, where:

FIG. 1—is the schematic view of a washer/dryer.

Figure 2:
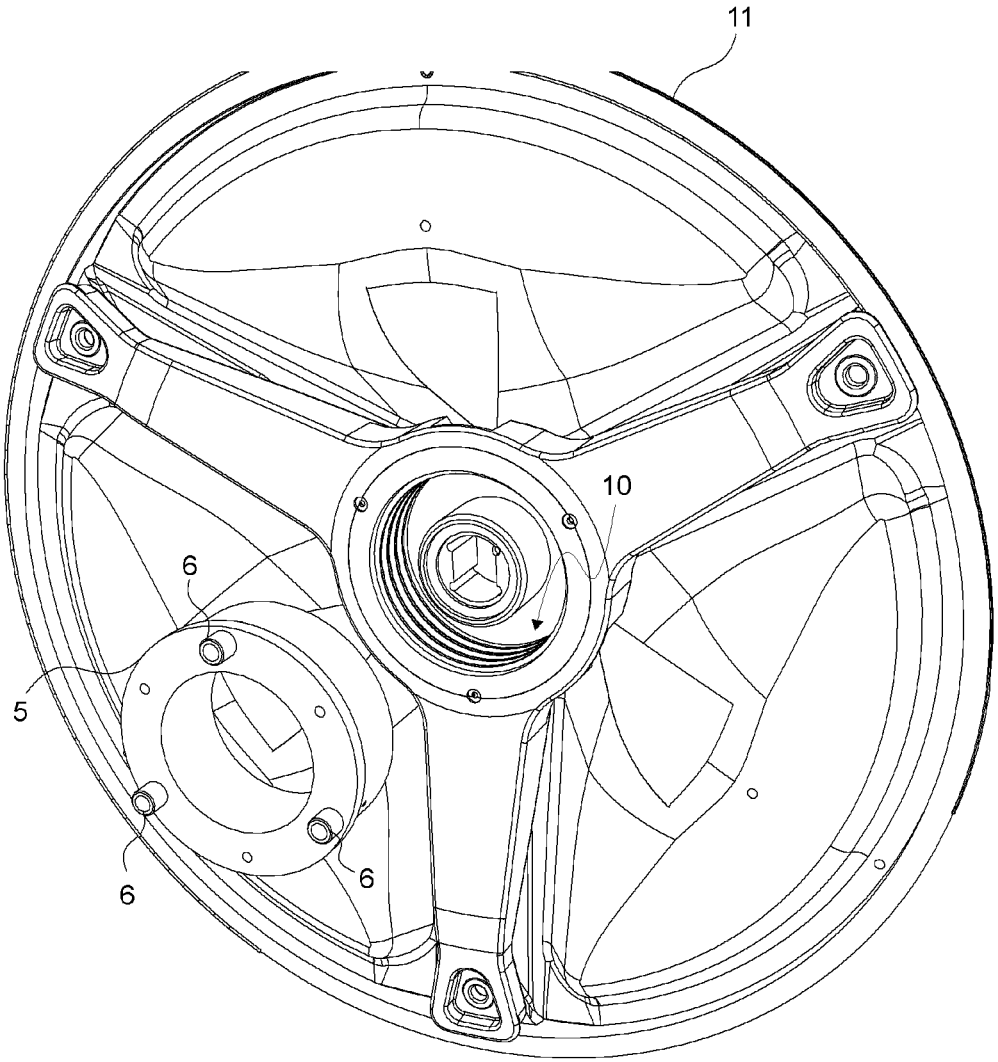

FIG. 2—is the exploded view of the rear wall and the shaft bearing.

Figure 3:
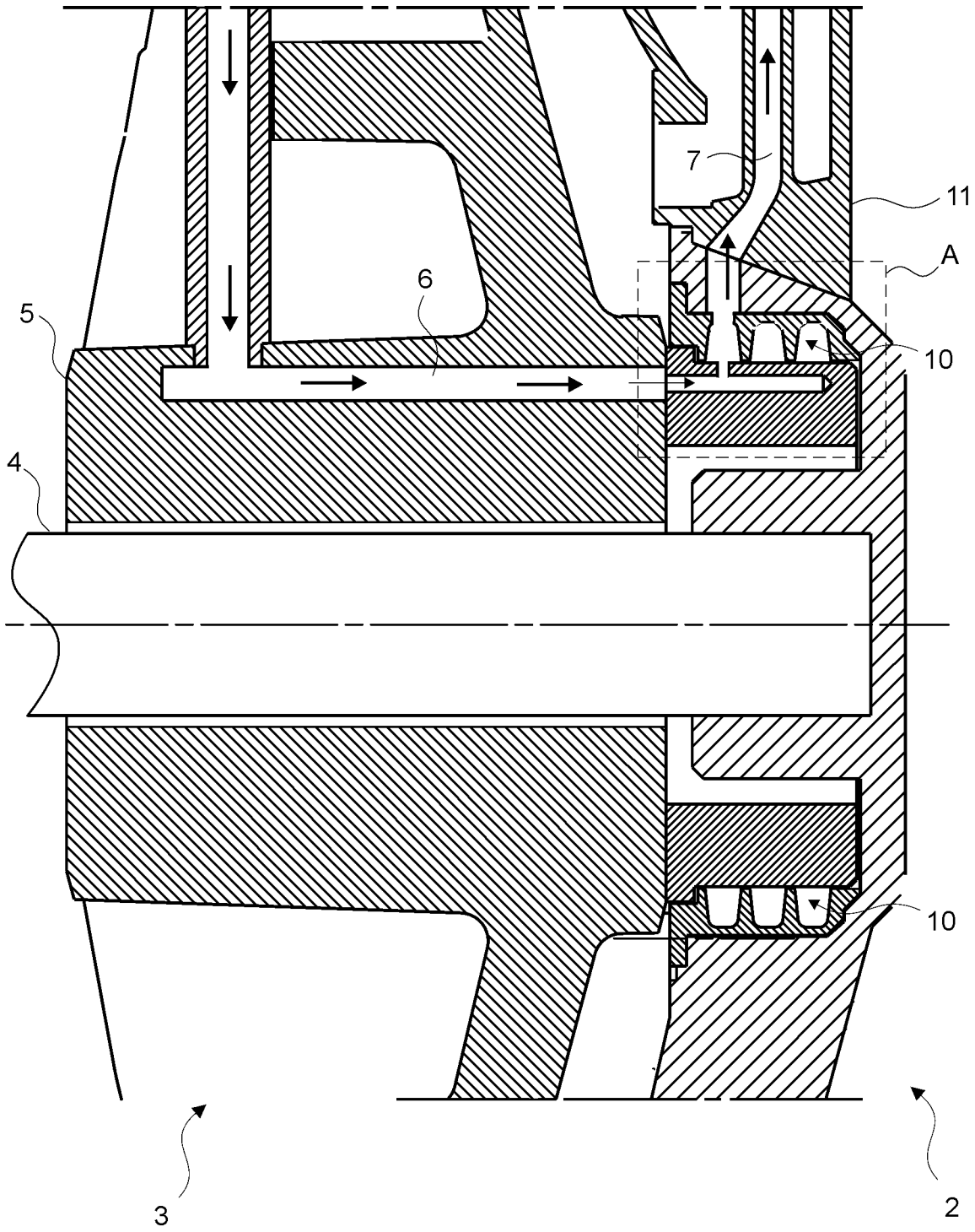

FIG. 3—is the cross-sectional view of the tub, drum and the bearing.

Figure 4:
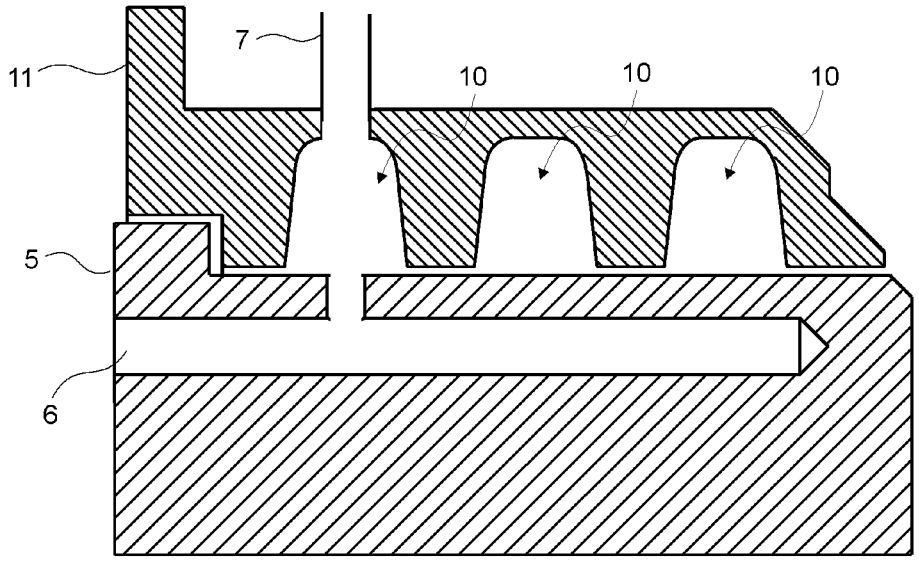

FIG. 4—is the cross-sectional view of detail A in FIG. 3.

Figure 5:
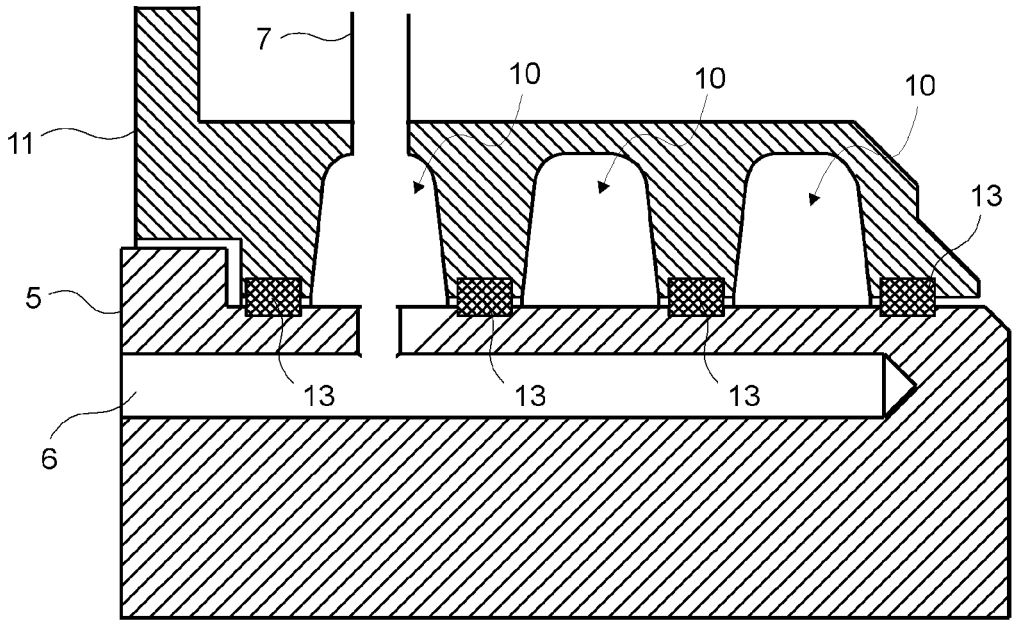

FIG. 5—is the cross-sectional view of yet another embodiment of the present invention.

Figure 6:
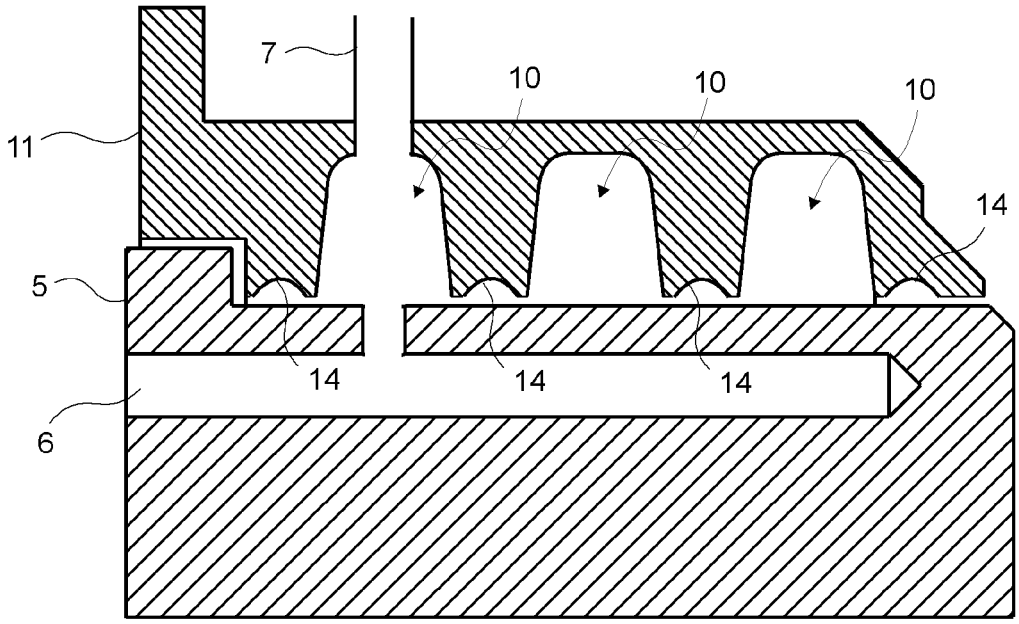

FIG. 6—is the cross-sectional view of another embodiment of the present invention.

Figure 7:
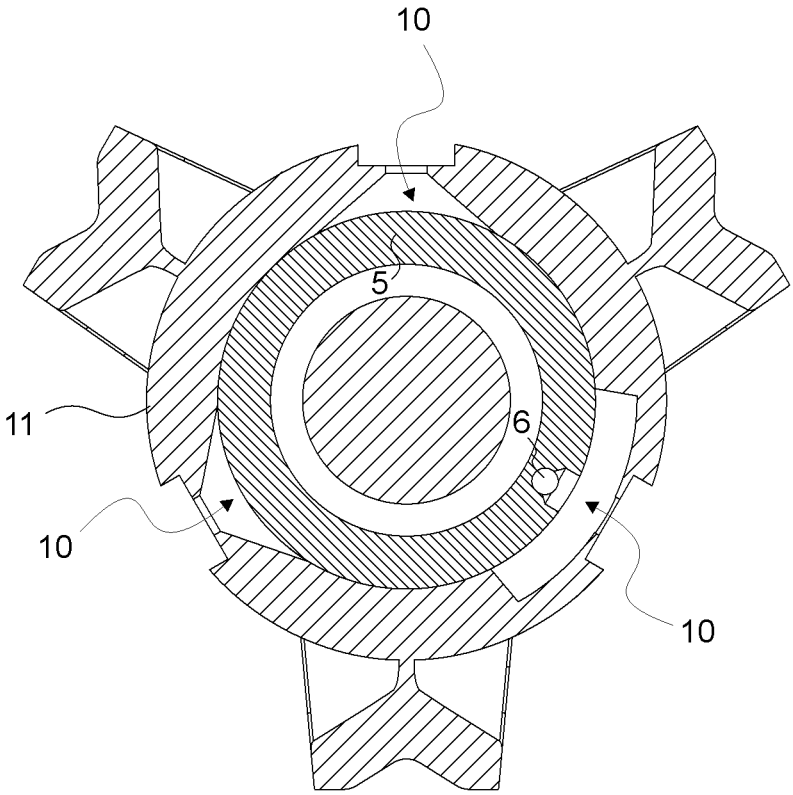

FIG. 7—is the cross-sectional view of yet another embodiment of the present invention.

The elements illustrated in the figures are numbered as follows:

1. Washer/dryer
2. Drum
3. Tub
4. Shaft
5. Bearing
6. Feeder line
7. Distribution line
8. Control unit
9. Valve
10. Trough
11. Rear wall
12. Chamber

13. Sealing element

14. Channel

The washer/dryer (1) of the present invention comprises a cylindrical drum (2) having a rear wall (11) wherein the laundry to be washed is emplaced, a tub (3) in which the drum (2) moves, a motor that rotates the drum (2), a shaft (4) that is housed on the tub (3) and transfers the movement received from the motor to the drum (2) and a bearing (5) situated at the center of the tub (3) wherein the shaft (4) is housed, extending towards the center of the drum (2) and that remains stationary together with the tub (3).

The washer/dryer (1) comprises one or more chambers (12) disposed on the drum (2) whereto fluid is delivered when there is a load unbalance for counterbalancing the unbalanced load, at least one feeder line (6) disposed in the bearing (5) having an inlet connected to the main supply and an outlet opening outside the bearing (5) and at least one distribution line (7) disposed on the rear wall (11), rotating together with the drum (2) and maintaining the connection between the feeder line (6) and the chamber (12) (FIG. 1).

The washer/dryer (1) furthermore comprises at least one valve (9) disposed on each feeder line (6) for controllably receiving water from the main supply to the feeder line (6) and a control unit (8) that identifies the amount and position of the unbalanced load when unbalanced load is detected, deciding which chamber (12) will receive what amount of water and opens, closes the valves (9) accordingly.

The washer/dryer (1) comprises one or more troughs (10) disposed on the rear wall (11)

at least partially and radially encompassing the portion of the bearing (5) extending into the rear wall (11) and rotating together with the drum (2) around this portion, connecting the feeder and the distribution lines (6 and 7) by forming a space whereto the feeder line (6) and the distribution line (7) opens (FIG. 2 and FIG. 3).

A trough (10) is disposed opposite the outlet of each feeder line (6) and the inlet of a distribution line (7) is connected to each trough (10). The trough (10) maintains the fluid leaving the feeder line (6) to be constantly delivered to the distribution line (7) (as long as water flows with a certain flow rate) with the effect of the centrifugal force generated as a result of the rotating drum (2). The trough (10) that covers the outlet of the feeder line (6) rotates together with the drum (2) over the bearing (5) and while providing the water leaving the feeder line (6) to pass into the distribution line (7) virtually sucks in the water in the feeder line (6) by the effect of the centrifugal force. Water is delivered to each chamber (12) by passing through a feeder line (6), a trough (10) and a distribution line (7). Consequently water can be delivered to each chamber (12) independently.

In this embodiment of the present invention, the trough (10) also rotates over the bearing (5) during the rotational movement of the drum (2). The feeder line (6) extending along the shaft (4) inside the bearing (5) opens into the space defined by the trough (10) from the portion of the bearing (5) corresponding to the trough (10). At the same time, the distribution line (7) also opens into the space defined by the trough (10). In this embodiment, the outlet of the feeder line (6) is disposed on an axis that is virtually perpendicular to the axis of the shaft (4) (FIG. 4).

When the washer/dryer (1) is operated, the chamber (12), the distribution line (7) and the trough (10) rotate together with the drum (2). When unbalanced load is detected by the control unit (8), the amount and position of the unbalanced load is specified and the control unit (8) decides which chamber (12) on the drum (2) will receive how much water. According to this decision, the valve (9) disposed on the feeder line (6) connected to the main supply opens. Water that flows in the feeder line (6) reaches the outlet of the feeder line (6) and passes from the feeder line (6) into the trough (10) rotating together with the drum (2). The water adhering to the walls of the trough (10) with the effect of centrifugal force generated due to the rotation of the trough (10) is directed to the inlet of the water distribution line (7). Water received into the distribution line (7) from the trough (10) reaches the respective chamber (12).

In the preferred embodiment of the present invention, three chambers (12) are arranged on the drum (2) having 120° angles there between, three feeder lines (6) on the bearing (5) and three distribution lines (7) on the rear wall (11). In this embodiment, moreover, three troughs (10) are disposed side by side and one inlet of a distribution line (7) and one outlet of a feeder line (6) are connected to each one. The feeder lines (6) have different lengths and the outlet of each one opens into a trough (10). Accordingly, depending on which chamber (12) water is intended to be delivered, the valve (9) on the feeder line (6) that delivers water to that chamber (12) is opened.

In another embodiment of the present invention, the trough (10) is disposed on an arc segment or segments that face the outlet of the feeder line (6) with a certain angle in the portion of the bearing (5) extending into the rear wall (11) and encompasses the bearing (5). In this embodiment, water that leaves the feeder line (6) can be delivered into the trough (10) only when the trough (10) corresponds with the outlet of the feeder line (6).

In another embodiment of the present invention, the washer/dryer (1) comprises more than one trough (10) on a single line, into which the outlet of a feeder line (6) opens. Thus all the troughs (10) are disposed on the same plane and thereby the length of the bearing (5) is reduced (FIG. 7).

In yet another embodiment of the present invention, the trough (10) encompasses the portion of the bearing (5) extending into the rear wall (11) all around. Accordingly water can be delivered from the feeder line (6) to the distribution line (7) hence to the chamber (12) without requiring any timing.

In another embodiment of the present invention, the inlet of the distribution line (7) is disposed on the base of the entrance trough (10).

In another embodiment of the present invention, the trough (10) preferable has a conical cross-section that gets narrower in the flow direction of the water. In this embodiment of the present invention, the trough (10) cross-section can also be frustoconic or quadrangular.

In another embodiment of the present invention, the width of the trough (10) is at least equal to or greater than the width of the feeder line (6) outlet.

In another embodiment of the present invention, the washer/dryer (1) comprises one or more sealing elements (13) situated between the troughs (10) and remaining between the bearing (5) and the drum (2) for preventing water passage between the troughs (10) (FIG. 5). Thus the required amount of water can be delivered to the respective chamber (12) without any leakage or seepage. Gaskets of plastic, felting etc. can be used as the sealing element (13).

In another embodiment of the present invention, the washer/dryer (1) comprises at least one channel (14) disposed between the troughs (10). In this embodiment, the washer/dryer (1) comprises one or more channels (14) between the troughs (10) and having a depth less than the troughs (10), preventing water passage between adjacent troughs (10) by forming a water screen due to the water filled therein (FIG. 6). Thus water passage between the troughs (10) is prevented without using a sealing element (13). Failures that may arise due to wearing out of the sealing elements (13) are also prevented since sealing element (13) is not used.

By means of the present invention, unbalanced load is counterbalanced by mechanically and continuously delivering water to the required region for decreasing the effect to a minimum when the control unit (8) detects a condition of unbalanced load.

The invention claimed is:

1. A washer/dryer (1) that comprises a cylindrical drum (2) having a rear wall (11) wherein the laundry to be washed is emplaced, a tub (3) in which the drum (2) moves, a shaft (4) that is housed on the tub (3) and transfers the movement to the drum (2), a bearing (5) situated at the center of the tub (3) wherein the shaft (4) is housed, extending towards the center of the drum (2) and that remains stationary together with the tub (3), one or more chambers (12) disposed on the drum (2) whereto fluid is delivered when there is a load unbalance for counterbalancing the unbalanced load, at least one feeder line (6) disposed in the bearing (5) having an inlet connected to the main supply and an outlet opening outside the bearing (5) and at least one distribution line (7) disposed on the rear wall (11), maintaining connection between the feeder line (6) and the chamber (12), rotating together with the drum (2) and characterized by one or more troughs (10)—disposed on the rear wall (11)—at least partially and radially encompassing the portion of the bearing (5) extending into the rear wall (11) and—rotating together with the drum (2) around this portion,—connecting the feeder and the distribution lines (6 and 7) by forming a space whereto the feeder line (6) and the distribution line (7) opens.

2. A washer/dryer (1) as in claim 1, characterized by a trough (10) that encompasses the portion of the bearing (5) extending into the rear wall (11) all around.

3. A washer/dryer (1) as in claim 1, characterized by a trough (10) that is disposed on an arc segment that faces the outlet of the feeder line (6) with a certain angle in the portion of the bearing (5) extending into the rear wall (11) and encompassing thereof.

4. A washer/dryer (1) as in claim 1, characterized by side by side disposed troughs (10) each opened to one inlet of a distribution line (7) and one outlet of a feeder line (6).

5. A washer/dryer (1) as in claim 4, characterized by feeder lines (6) of different lengths wherein the outlet of each opens to a trough (10).

6. A washer/dryer (1) as in claim 1, characterized by a feeder line (6) the inlet of which is disposed on the base of the trough (10).

7. A washer/dryer (1) as in claim 1, characterized by a trough (10) having a cross-section that gets narrower in the direction of the water flow.

8. A washer/dryer (1) as in claim 1, characterized by a trough (10) the width of which is at least equal to or greater than the width of the feeder line (6) outlet.

9. A washer/dryer (1) as in claim 1, characterized by one or more sealing elements (13) situated between the troughs (10) and remaining between the bearing (5) and the drum (2) for preventing water passage between the troughs (10).

10. A washer/dryer (1) as in claim 1, characterized by one or more channels (14) between the troughs (10) having a depth less than the troughs (10), and remaining between the bearing (5) and the rear wall (11) for preventing water passage between adjacent troughs (10) by forming a water screen due to the water filled therein.

* * * * *